US007296702B2

(12) United States Patent
Tanaka et al.

(10) Patent No.: US 7,296,702 B2
(45) Date of Patent: Nov. 20, 2007

(54) SYNTHETIC RESIN BOTTLE

(75) Inventors: Toshimasa Tanaka, Tokyo (JP); Takao Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 202 days.

(21) Appl. No.: 11/172,941

(22) Filed: Jul. 5, 2005

(65) Prior Publication Data

US 2007/0007234 A1 Jan. 11, 2007

(51) Int. Cl.
*B65D 1/44* (2006.01)
*B65D 1/02* (2006.01)

(52) U.S. Cl. ..... 215/383; 215/379; 215/381; 220/669; 220/671; 220/675

(58) Field of Classification Search ..... 215/379, 215/382, 383, 381, 384; 220/669, 671, 675, 220/609, 666

See application file for complete search history.

(56) References Cited

U.S. PATENT DOCUMENTS 3,536,500 A * 10/1970 Cleereman et al. ..... 426/130
3,702,806 A * 11/1972 Oliva ..... 435/304.1
3,923,178 A * 12/1975 Welker, III ..... 215/381
4,380,526 A * 4/1983 Agrawal ..... 264/537
4,946,053 A * 8/1990 Conrad ..... 215/381
5,117,993 A * 6/1992 Vesborg ..... 215/382
5,133,469 A * 7/1992 Mehta et al. ..... 215/10
5,746,260 A * 5/1998 Vesborg ..... 141/319
5,866,419 A * 2/1999 Meder ..... 435/394
D467,183 S * 12/2002 Chew ..... D9/561
6,637,613 B2 * 10/2003 Shimada et al. ..... 215/382
2004/0045206 A1 * 3/2004 Witham ..... 40/642.02
2004/0099673 A1 * 5/2004 Burgassi et al. ..... 220/669

FOREIGN PATENT DOCUMENTS

JP A 2001-322616 11/2001

* cited by examiner

*Primary Examiner*—Sue A. Weaver
(74) *Attorney, Agent, or Firm*—Oliff & Berridge, PLC

(57) ABSTRACT

A synthetic resin bottle, protected from damage to the outer appearance under freezing conditions, and is effective in storage and transportation. The bottle is used by filling the bottle with contents have water as a main component and freezing such contents. The bottle comprises a body that has an out-of-round circular shape in the plane cross section over a certain height of the body, and the body wall has no hollowed portion caved inward. The body gradually narrows in the middle part except for the portions consisting of crests which are disposed at 3 or more points of the same central angle on the periphery of the plane cross section. In the middle part, the plane cross section is in the shape obtained by connecting the crests to one another with 3 or more arcs that curve outward. Pillars are formed vertically on the body by the crests.

15 Claims, 9 Drawing Sheets

(a)

(b)

SYNTHETIC RESIN BOTTLE

TECHNICAL FIELD

This invention relates to a synthetic resin bottle, and in particular, to a synthetic resin bottle to be used by freezing the contents consisting primarily of water.

BACKGROUND ART

Synthetic resin bottles made of those resins containing polyethylene terephthalate (hereinafter referred to as PET) are in wide use for drinking water, sports drinks, tea, juice, and the like. These drinks are marketed by wrapping the bottles with printed shrink for labeling the commodity name or from a design point of view. Patent Document 1, for example, describes an invention concerning a bottle with its body wrapped in shrink film.

[Patent Document 1]: Japanese patent application No. 2001-322616

In summer, these bottles may be put in the freezer to freeze the drinks. Then, the frozen bottles are taken out to melt the drinks gradually to have ice-cold drinks.

DISCLOSURE OF THE INVENTION

If water freezes, its volume increases by 1.09 times from the original volume. In the sealed bottle, pressure inside the bottle would also rise with the freeze-derived increase in volume, and the bottle could be in danger of breakage. Even if the bottle is not broken, it may deform to a large extent.

If a bottle is provided with hollowed portions, such as vacuum panels 6, on the body wall, as found in the round PET bottle shown in FIG. 7, then the freeze-derived volume increase can be absorbed by these portions which undergo deformation into the swelled shape. However, in the case of a bottle wrapped in shrink film, the film may be broken. Due to the expansion of above-described hollowed portions, the bottle may be distorted in shape, thus spoiling the outer appearance of the bottle.

This invention has been made to solve the above-described problems. The technical problem of this invention is to create a bottle in such a shape that can fully absorb a freeze-derived increase in volume, does not break the shrink film if the bottle is wrapped in the shrink film, and gives no large damage to the outer appearance of the bottle. The object of this invention is to provide a synthetic resin bottle, which is usable safely, is protected against any large damage to the outer appearance under the freezing condition, and is effective in the storage and/or transportation of multiple bottles neatly packed in rows.

The means of carrying out the invention of Claim 1 to solve the above-described technical problems is a synthetic resin bottle comprising a body that has an out-of-round circular shape in any cross-sectional plan view taken over a certain height of said body wherein the out-of-round circular shape has no hollowed portion that is caved inward.

If the bottle freezes and expands, causing inner pressure to act on the bottle, there would occur the so-called hoop stress in the peripheral direction of the body wall. The inventors of this invention have observed and considered the pattern of bottle deformation at the time of freeze. They have found that at a temperature near freezing point, there is no drawing of the synthetic resin, such as the PET resin, of which the bottle is made. The inventors have also found that the plane cross section of the body deforms so as to increase the cross-sectional area, while maintaining the same circumferential length and that hollowed portions expand outward if the bottle has these portions, such as, e.g., vacuum panels. These findings led the inventors to discover the means of carrying out the invention of Claim 1.

In the invention of Claim 1, the plane cross section of the body has the shape of an out-of-round circle having no hollowed portion that is caved inward. Under this configuration, there is no reversible deformation into the swelled shape even if the volume increases due to the freeze. Instead, the plane cross section changes from the out-of-round circle to a corresponding perfect circle to absorb the volume increment, while maintaining the constant circumferential length.

Therefore, even if shrink film is wrapped around the body up to a given height, the circumferential length of the shrink film is almost the same as that of the plane cross section of the body. When the bottle is frozen, the plane cross section of the body simply changes from the out-of-round circle to a perfect circle, but maintains a constant circumferential length. Since the shrink film changes in its cross-sectional shape with the deformation of the body but is not pulled in the peripheral direction, there is no possibility that the shrink film is broken. Generally, shrink film has a perforated line or lines in the vertical direction for the purpose of separate disposal. Rupture, if any, of the shrink film tends to occur along these perforated lines.

If the plane cross section of the body has hollowed portions, such as vacuum panels shown in FIG. 7, the body is wrapped in shrink film in such a way that the film connects linearly between adjacent bases across the hollowed portions (See the cross-sectional plan view of FIG. 8). In that case, an empty space is formed between the film and the bottom of each hollowed portion. Under such a condition, the circumferential length of the body in the plane cross section becomes longer than the circumferential length of the shrink film. When the hollowed portions expand because of a freeze-derived increase in the volume of contents, a force acts on the shrink film to pull the film in the circumferential direction and breaks the film.

The composing element of Claim 1 is that the body in its plane cross section is in the shape of an out-of-round circle over a certain height of the body. This composing element shows a means of absorbing the freeze-derived volume increase, while maintaining a constant circumferential length in the plane cross section of the body under the condition that there is no reversible deformation into the swelled shape.

As described above, the body has the shape of an out-of-round circle in any plane cross section taken over a certain body height. When the out-of-round circle is allowed to come close to the perfect circle, the plane cross section has a maximum area, while maintaining a constant circumferential length. This is because the perfect circle gives the largest cross-sectional area under the condition of a constant circumferential length. Thus, the freeze-derived increase in volume can be absorbed by this increase in the cross-sectional area.

The volume increment to be absorbed by the increase in the cross-sectional area of the bottle body can be determined by taking into consideration the extent to which the volume of frozen contents increases and the size of head space on the surface of the liquid product with which the bottle has been filled. Based on these considerations, it is possible to determine the body height, over which the plane cross section is kept in the shape of an out-of-round circle, and how much out-of-roundness the circle should have. The head space has an allowable limit from a merchantability point of view. In many cases, this head space cannot absorb all the freeze-derived volume increase. It is also necessary for the cap seal to be prevented from getting damaged by the compression of head space air that may be caused by the freeze-derived volume increase. Therefore, all the volume of this head space cannot always be utilized.

Furthermore, the shape of the out-of-round circle need not have the same shape over the given height of the in a predetermined height range. The out-of-round shape and the extent of out-of-shape can be varied in the direction of height.

The extent of out-of-roundness can be expressed by, e.g., compression rate as used in elliptical shapes. However, in connection with the technical ideas of this invention, it is preferred that the index showing the extent of out-of-roundness is Sc/Sa (hereinafter referred to as Rs value) which is a ratio of Sc to Sa where Sa is a plane cross-sectional area at a given height of the body, and Sc is an area of a perfect circle having the same circumferential length as that of this plane cross section. This Rs value is 1 when the plane cross section at a given height of the body is in a perfect circle. If the Rs value is, say, 1.2, then this value indicates that the cross-sectional area can be 1.2 times as much as that of the out-of-round circle when this circle turns to a perfect circle. With this value as a guide, forecasting can be made as to how much increase in the volume can be absorbed.

By comparison, Rs values are given for some shapes. In the case of regular polygons, an Rs of 1.62 is given for regular triangle; 1.27 for regular quadrangle; 1.08 for regular hexagon; and 1.05 for regular octagon. In the case of ellipses, an Rs of 1.06 is given for an ellipse with a long/short diameter ratio of 1.5; and 1.19 at a ratio of 2.0. These Rs values were calculated geometrically. In fact, however, it is necessary to take the deformability to a round shape into consideration because this deformability is affected by wall thickness distribution in the circumferential direction of the body wall. Meanwhile, the volume increase caused by freezing water is 1.09 times as calculated from the ice density of 0.917 g/cm$^3$ at 0° C. and water density of 0.998 g/cm$^3$ at 20° C.

The means of carrying out the invention of Claim 2 exists in the configuration that in the invention of Claim 1, the body of the bottle narrows gradually in the middle part from the size of the plane cross section in the upper and lower parts of the body.

Under the above-described configuration of Claim 2, the middle part of the body is where the freeze-derived deformation is apt to make the body expand. If this part is narrowed, the deformation of this part into a circular cross section would remain inconspicuous from an appearance point of view. It is also possible for the body not to expand outward beyond the diameter of the shoulder or the bottom. Many frozen bottles neatly packed in rows can be effectively stored or transported under the freezing condition. It should be noted here that the narrow part of the body is not necessarily limited to the middle part, but can be any part of the body suitably selected while giving consideration to the function for absorbing the volume increment or the outer appearance of the bottle. From that standpoint, the "middle" part may also come close to the upper or lower part of the body.

The means of carrying the invention of Claim 3 exists in the configuration that in the invention of Claim 1 or 2, the plane cross section of the body to be taken over a given height is in a shape selected from among an elliptical shape, an oval shape, a polygonal shape, and a polygonal shape having corners rounded in an arc.

Under the configuration of Claim 3, all the elliptical, oval, and polygonal shapes, and the polygonal shape having corners rounded in an arc are out-of-round circles with no hollowed portions. Either shape can be selected while giving consideration to bottle application, outer appearance, and Rs value associated with the freeze-derived volume increment.

The means of carrying out the invention of Claim 4 exists in the configuration that in the invention of Claim 1 or 2, the body in its plane cross section has a shape in which a plurality of arcs that curve outward is connected to one another.

The freezing inside the bottle does not always go along uniformly, depending on temperature distribution in the freezer, the posture and direction of the bottle, and the like. In order for the freeze-derived volume increase to be effectively absorbed, it is necessary to select not only an appropriate level of above-described Rs value, but also a plane cross-sectional shape that can be smoothly changed to a perfect circle at the time of freezing.

Under the configuration of Claim 4, the plane cross-sectional shape of the body can be organized variously by gentle arcs so that the plane cross section can be changed easily to a perfect circle. Since the deformation proceeds smoothly, the shrink film, too, deforms easily, and wrinkles, if any, can be minimized. The effect of deformation on the outer appearance is so small that the freeze never reduces merchantability of the bottle.

The means of carrying out the invention of Claim 5 to solve the above-described technical problems exists in the configurations:

- that the synthetic resin bottle of Claim 1 has the body in a cylindrical shape, with the plane cross shape being almost an isotropic shape;
- that the body gradually narrows in the middle part from the size of the plane cross section in the upper and lower parts, except for the portions consisting of the crests which are disposed at 3 or more points of almost an equal central angle on the periphery of the plane cross section;
- that the plane cross section of the body in the middle part is in the shape obtained by connecting said crests to one another with the arcs that curve outward; and
- that pillars are formed vertically on the body by the crests.

Under the configurations of Claim 5, the upper and lower parts of the body are in a roughly cylindrical shape. The body gradually narrows in the middle part from the size of the plane cross section in the upper and lower parts, except for the portions consisting of the crests which are disposed at 3 or more points of an almost equal central angle on the periphery of the plane cross section. The plane cross section of the body in the middle part is in the shape obtained, without forming any reversible portion, by connecting said crests to one another with the arcs that curve outward. The body in its plane cross section has no sunken (hollowed) portion or no reversible portion where the radius of curvature is reversed from minus to plus or vice versa. Even in the case in which shrink film is wrapped around the body, the circumferential length of the plane cross section of the body can be approximately equal to that of the shrink film that is wrapped around the body.

Thus, the circumferential length of the body in the plane cross section is rendered approximately equal to that of the shrink film wrapped around the body. Even if the plane cross section of the body deforms due to the freeze, the shrink film, too, changes its plane cross-sectional shape in response to the change in the plane cross section of the body. But since there is no pull in the circumferential direction, the shrink film is protected against rupture.

Under the configuration of Claim 5, the plane cross section of the body is roughly in a circle (including polygons), close to a perfect circle, in the upper and lower parts. However, in the middle part, the plane cross section is in the shape of an out-of-round circle that is formed by connecting the crests to one another with the arcs that curve outward, without forming any reversible portions. Furthermore, the body of the bottle gradually narrows in the middle part from the size of the plane cross section in the upper and lower parts of the body. Under this configuration, the plane cross section of the body is in the shape of an out-of-round circle over a major part of the body height.

Thus, the plane cross section of the body is given the shape of an out-of-round circle over a major part of the body height. When this out-of-round circle is allowed to come close to a perfect circle, the plane cross section has the largest cross-sectional area while maintaining a constant circumferential length. This is because the perfect circle has the largest area under the condition of a constant circumferential length. Therefore, it is possible for the increased cross-sectional area to absorb the freeze-derived volume increase.

The freezing process inside the bottle does not always go along uniformly,-depending on the temperature distribution in the freezer, the posture and direction of the bottle. In order for the freeze-derived volume increase to be effectively absorbed, it is necessary not only to select an appropriate level of above-described Rs value, but also to deform the plane cross-sectional shape smoothly into a shape close to the perfect circle at the time of freezing.

Under the configuration of Claim 5, the plane cross section of the body in the middle part is in the shape obtained, without forming any reversible portion, by connecting said crests to one another with the arcs that curve outward. In that case, the plane cross section can be in the shape consisting of gentle arcs that can be deformed easily into a perfect circle. This deformation proceeds smoothly, and if shrink film is wrapped around the body, the deformation of this film also proceeds smoothly, and wrinkles, if any, can be minimized.

Also under the configuration of Claim 5, the body gradually narrows in the middle part from the size of the plane cross section in the upper and lower parts, except for those portions consisting of the crests which are disposed at 3 or more points of an approximately equal central angle on the periphery of the plane cross section. Because the Rs value can be increased gradually in the middle part, the freeze-derived volume increase is absorbed by the deformation in the middle part where the body is narrow as compared to the size in the upper and lower parts. In addition, the deformation of the bottle can be kept inconspicuous.

When the bottle of Claim 5 is observed in the vertical direction, the cylindrical body wall partially retreats in the middle part. However, the bottle retains its rigidity by means of at least 3 pillars, which are formed vertically on the body and serve as vertical ribs. After the deformation caused by the freeze, these pillars enable the bottle to maintain an upright standing position. As a result, a synthetic resin bottle can be provided, which is usable safely, is protected from any large damage to the outer appearance under the freezing condition, and is effective in the storage and/or transportation of multiple bottles neatly packed in rows.

The means of carrying out the invention of Claim 6 exists in the configurations that in the invention of Claim 5, the plane cross section of the body in both the upper and lower parts has the shape of an n-th polygon where n is a natural number of 6 or more; and that at least 3 apexes located at almost an equal central angle are selected from among those apexes of said n-th polygon and are designated as the crests.

Under the configurations of Claim 6, pillars are formed from some of the polygonal apexes used as the crests. In addition, the body narrows in the middle part, while the remaining apexes form the ridge lines. Because of these configurations, the bottle has a good shape and gives high rigidity to the body.

The polygon is not limited to any specific one as long as it is a hexagon or a higher polygon in which all apexes are tangent to a circle. Nevertheless, it is preferred that the polygon is a regular n-th polygon where n is an even number, because the crests can be positioned at an equal central angle. It is also possible that each side of the polygon comprises an arc with a large radius of curvature, rather than a linear side. For example, 3 apexes can be positioned at an equal central angle in the regular hexagon; 4 apexes in the regular octagon; and 3, 4, or 6 apexes in the regular dodecagon.

The means of carrying out the invention of Claim 7 exists in the configurations that in the invention of Claim 5, the plane cross section of the body in the upper and lower parts is in the shape of a regular hexagon, with the alternately located apexes being designated as the crests, and that the plane cross section in the middle part is in a tri-axially symmetrical shape.

The body in its plane cross section has a tri-axially symmetrical shape in the middle part of the body. This configuration ensures that the bottle is not flat, but is almost an isotropic shape in the circumferential direction, and prevents the shape of a round bottle from being damaged largely. The Sc value of the plane cross section can also be increased.

The means of carrying out the invention of Claim 8 exists in the configuration that in the invention of Claim 5, 6, or 7, the crests have a rounded shape in the plane cross section of the body.

Under the configuration of Claim 8, wide pillars can be formed in the vertical direction of the body, so that the pillars may serve more effectively as the vertical ribs.

The means of carrying out the invention of Claim 9 exists in the configuration that in the invention of Claim 1, 2, 5, 6, or 7, circumferential ribs are formed in the upper and lower parts of the body.

Under the above-described configuration of Claim 9, the circumferential ribs formed in the upper and lower parts of the body can be used to define the upper and lower limits to the area where the body is deformed by the freeze. These ribs help prevent the shoulder and the bottom reliably from deforming, and maintain the bottle in a very good shape after the deformation. Since these ribs never give damage to the stable standing posture given by the bottom, the bottles can be packed neatly in rows for effective storage or transportation.

The means of carrying the invention of claim 10 exists in the configuration that in the invention of Claim 1, 2, 5, 6, or 7, the body is wrapped in shrink film.

Under the above-described configuration of Claim 10, it can be ensured that the plane cross section of the body has a circumferential length that is almost equal to that of the shrink film over the height of the body where shrink film is wrapped around the body. Even if the freeze causes the bottle to deform, the shrink film follows the deformation of the body and changes its cross-sectional shape. But since the shrink film is not pulled in the circumferential direction, there is no rupture of the shrink film, which tends to break along the perforated line or lines that are disposed vertically. The cross section of the body does not always have the shape of an out-of-round circle over the entire height of the body where the shrink film is wrapped around. A part of the plane cross section (for example, the upper and/or lower part) may have a perfect circle.

The means of carrying out the invention of Claim 11 exists in the configuration that the bottle specified in the invention of Claim 1, 2, 5, 6, or 7, is a biaxially drawn and blow-molded product made of a PET-series resin.

The biaxially drawn, blow-molded bottle made of a PET-series resin is in wide use as a bottle for beverage use, and has high mechanical properties even at a low temperature. The bottle can also be utilized by freezing the contents. In addition, the bottle can be wrapped in shrink label.

PET is mainly used as the PET-series resin. In addition to a major part of ethylene terephthalate units, those copolymerized polyesters containing other polyester units can also be used unless the essential quality of the PET-series resin is spoiled. For example, a PET-series resin can be blended with a nylon-related resin or a polyethylene naphthalate resin to improve the gas barrier property or the heat-resisting property. The ingredients for use in copolymerized polyesters include dicarboxylic acids, such as isophthalic acid, naphthalene-2,6-dicarboxylic acid, and adipic acid; and glycol ingredients, such as propylene glycol, 1,4-butanediol, tetramethylene glycol, neopentyl glycol, cyclohexane dimethanol, and diethylene glycol.

Furthermore, the bottle made of a PET-series resin may be provided with an intermediate layer of a nylon resin, as given by the layers consisting of a PET resin—a nylon resin—a PET resin, for the improvement of the heat-resisting property and/or gas barrier property.

EFFECTS OF THE INVENTION

This invention having the above-described configuration has the following effects:

In the invention of Claim 1, in any cross-sectional plan view taken over a certain height the body wall has no hollowed portion that is caved inward, and there is no reversible deformation into the swelled shape as caused by the freeze. Therefore, the freeze causes no rupture in the shrink film wrapped around the body, and the bottle can be stored and used without giving any damage to the merchantability of the bottle.

A plane cross section of the body in the shape of an out-of-round circle increases in the cross-sectional area with the change to a perfect circle. This deformation absorbs any freeze-derived volume increase without requiring reversible deformation into the swelled shape.

In the invention of Claim 2, the bottle gradually narrows in the middle part. The freeze-derived deformation of this part would remain inconspicuous from an appearance point of view. Many frozen bottles neatly packed in rows can be effectively stored or transported under the freezing condition.

In the invention of Claim 3, the out-of-round circle includes an elliptical shape, an oval shape, a polygonal shape, and a polygonal shape having corners rounded in an arc. Any of these shapes can be singled out by giving consideration to intended use, outer appearance, and freeze-derived volume increment.

In the invention of Claim 4, the body in its plane cross section has a shape in which a plurality of arcs that curve outward is connected to one another. This shape is easily deformable into a shape close to a perfect cycle. And the shrink film deform easily, too. Even if wrinkles have formed, they can be minimized. Since the deformation of the body has little effect on appearance, the freeze gives no large damage to the outer appearance.

In the invention of Claim 5, the body in its plane cross section has no sunken or hollowed portion or no reversible portion where the radius of curvature is reversed from minus to plus or vice versa. Even in the case in which shrink film is wrapped around the body, the circumferential length of the plane cross section of the body can be approximately equal to that of the shrink film which is wrapped around the body.

Thus, the plane cross section of the body is given the shape of an out-of-round circle over a major part of the body height. It is fully possible for such a shape to perform the function of absorbing the freeze-derived volume increase.

The plane cross section of the body in the middle part is in the shape obtained, without forming any reversible portion, by connecting the crests to one another with the arcs that curve outward. In that case, the plane cross section consisting of gentle arcs can be deformed smoothly into a perfect circle.

The body gradually narrows in the middle part from the size of the plane cross section in the upper and lower parts, except for those portions consisting of the crests. Because the extent of the out-of-roundness can be increased gradually in the middle part, the freeze-derived volume increase can be absorbed by the deformation in the middle part. In addition, the bottle deformation can be kept inconspicuous.

In addition, the bottle retains its rigidity by means of 3 or more pillars, which are formed vertically on the body and serve as vertical ribs. After the deformation caused by the freeze, these pillars enable the bottle to maintain an upright standing position. As a result, a synthetic resin bottle can be provided, which is usable safely, is protected from any large damage to the outer appearance under the freezing condition, and is effective in the storage and/or transportation of multiple bottles neatly packed in rows.

In the invention of Claim 6, the plane cross section of the body in both the upper and lower parts has the shape of a polygon, and at least 3 apexes located at an approximately equal central angle are selected from among those apexes of said polygon and are designated as the crests. The pillars are formed from these crests, and the body narrows in the middle part, while allowing the remaining apexes to form the ridge lines. Because of these configurations, the bottle has a good shape and gives high rigidity to the body.

In the invention of Claim 7, the plane cross section of the body in the upper and lower parts is in the shape of a regular hexagon. The body in its plane cross section has a tri-axially symmetrical shape in the middle part. This configuration ensures that the bottle is not flat, but is almost an isotropic shape in the circumferential direction, and prevents the shape of a cylindrical bottle from being damaged largely. It is possible for the plane cross section to have an increased extent of out-of-roundness.

In the invention of Claim 8, apexes to be used as the crests has a rounded shape, which allows wide pillars to be formed in the vertical direction of the body, so that the pillars may serve more effectively as the vertical ribs.

In the invention of Claim 9, the circumferential ribs formed in the upper and lower parts of the body can be used to define the upper and lower limits to the area where the body is deformed by the freeze. These ribs help maintain the bottle in a very good shape after the deformation. Since the ribs never give damage to the stable standing posture given by the bottom, the bottles can be packed neatly in rows for effective storage or transportation under the freezing condition.

In the invention of Claim 10, it can be ensured that the plane cross section of the body has a circumferential length that is almost equal to that of the shrink film wrapped around the body if such film is used. Even if the freeze causes the volume of contents to increase, there is no rupture in the shrink film, which tends to break along the perforated lines that are disposed vertically.

In the invention of Claim 11, the biaxially drawn, blow-molded bottle made of a PET-series resin can be widely utilized for applications involving freeze.

PREFERRED EMBODIMENTS OF THE INVENTION

Figure 1:
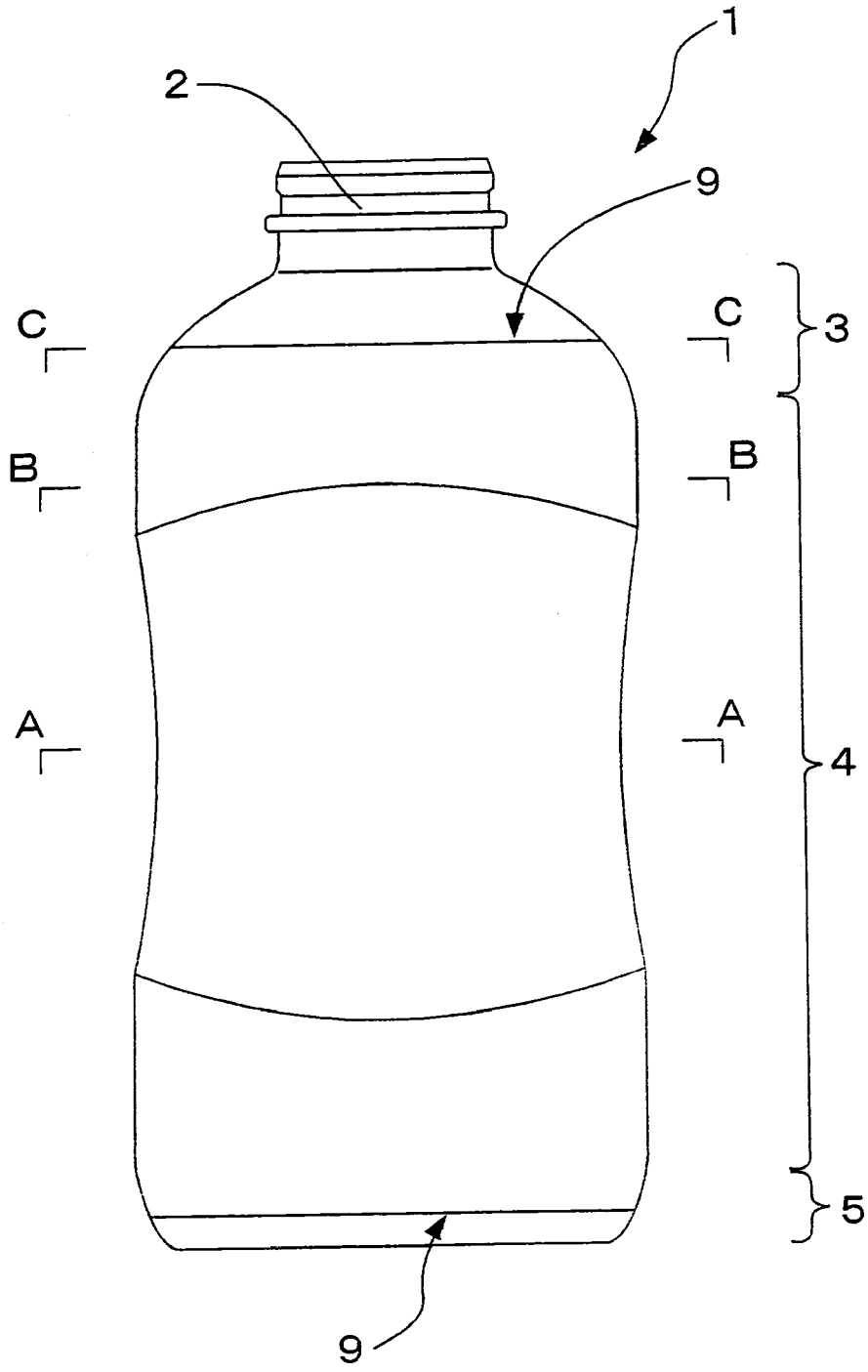
FIG. 1 is a front elevational view of the bottle in the first embodiment of this invention.
Figure 2:
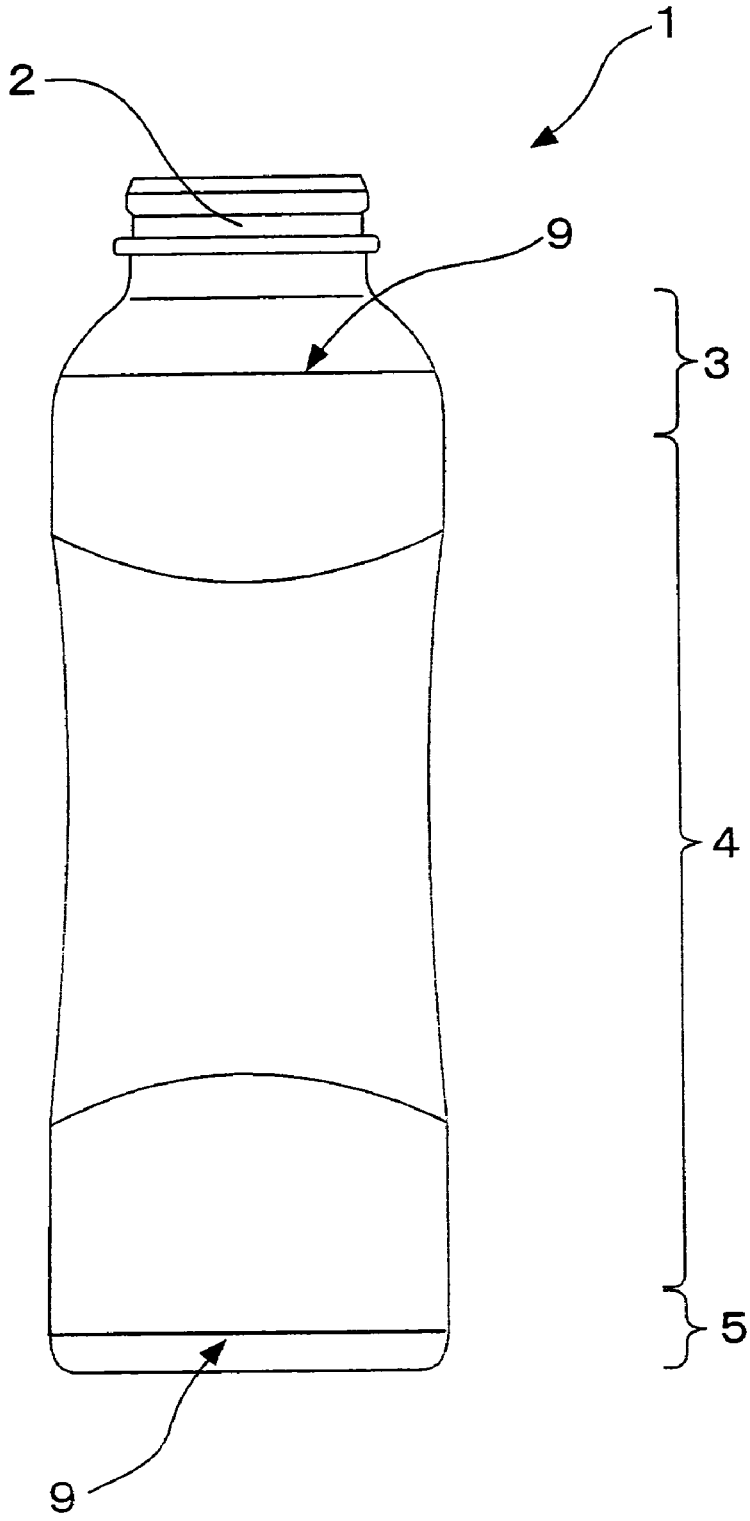
FIG. 2 is a side elevational view of the bottle shown in FIG. 1.

This invention is further described with respect to preferred embodiments of this invention, now referring to the drawings. FIGS. 1-4 show the synthetic resin bottle in the first embodiment of this invention, which is a biaxially drawn, blow-molded PET bottle with a capacity of 350 ml. On the whole, the bottle 1 has a flat shape and comprises neck 2, shoulder 3, body 4, and bottom 5. Viewed vertically, the bottle narrows gradually in the middle part.

Figure 3:
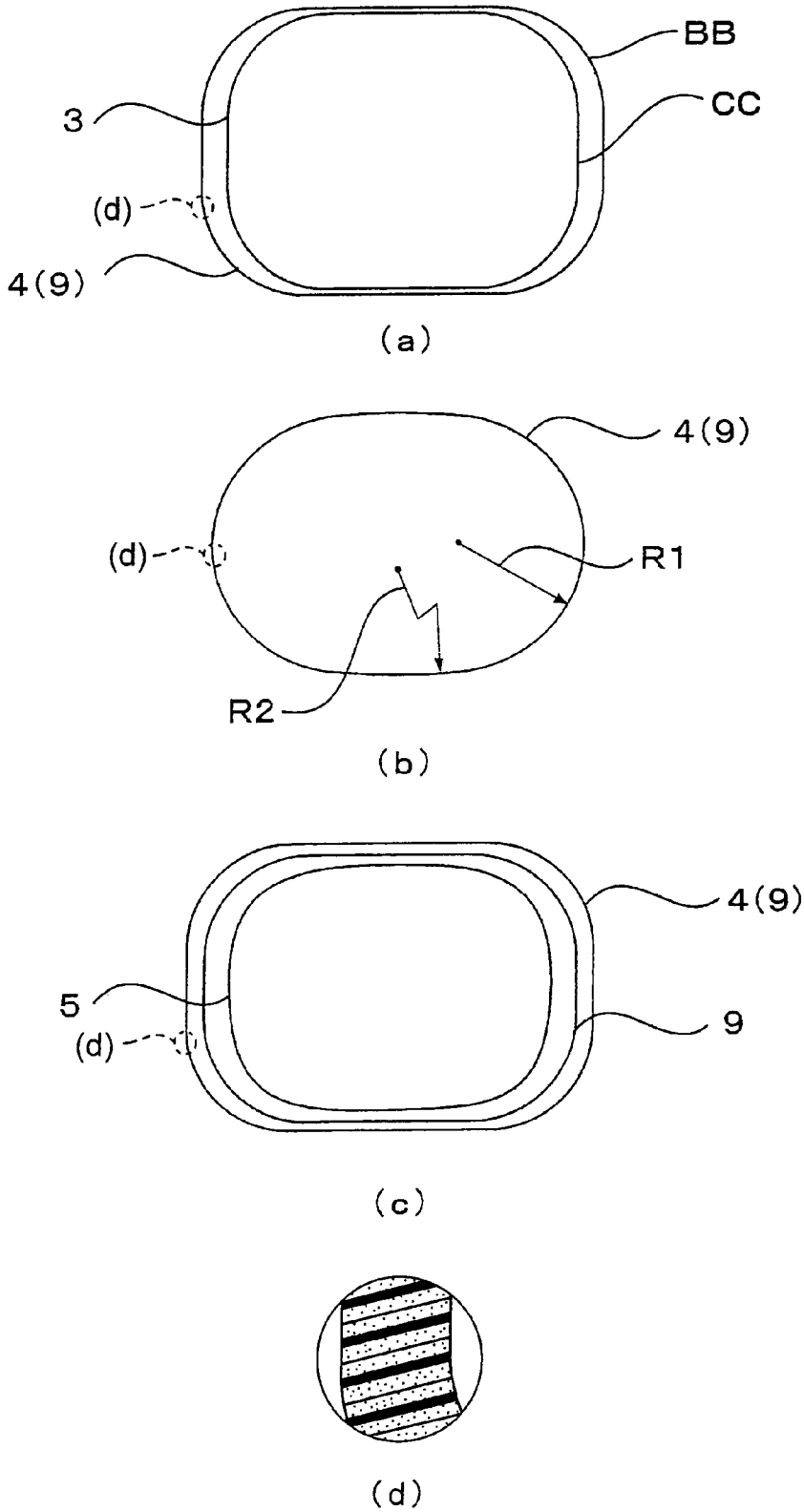
FIG. 3 show the bottle of FIG. 1, in which (a) is a cross-sectional plan view taken from lines B-B and C-C in FIG. 1; (b) is a cross-sectional plan view taken from line A-A in FIG. 1; (c) is a bottom plan view; and (d) is a cross-sectional plan view of a portion of the bottle of FIG. 1.
Figure 4:
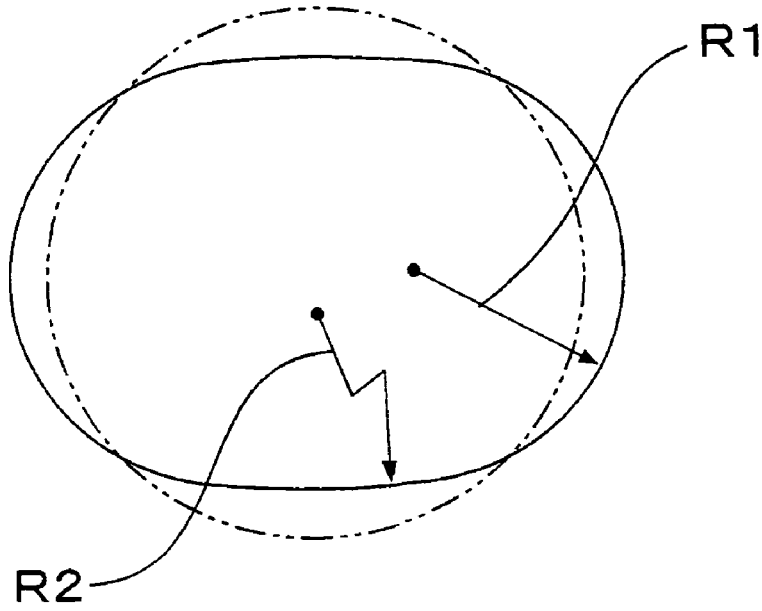
FIG. 4 is an explanatory diagram in which the cross-sectional plan view of (b) is compared with a circle having the same circumferential length.

FIGS. 3 show cross-sectional plan views (FIGS. 3(*a*) and 3(*b*), a bottom plan view (FIG. 3(*c*)), and a cross-sectional plan view of a portion of the bottle of the first embodiment showing the synthetic resin composition (FIG. 3(*d*)). FIG. 3(*a*) shows two plane cross sections, in which BB is a plane cross section in the upper part of the body, taken from line B-B, and in which CC is the one on the shoulder, taken from line C-C. Since the shrink film 9 is wrapped around the body 4 tightly, the plane cross-sectional shape of the body 4 and the shrink film 9 are drawn by the same line in FIGS. 3.

As obvious from FIGS. 3, the plane cross section of the body 4 has a rectangular shape with corners being rounded in the upper and lower parts (See FIGS. 3(*a*) and 3(*c*)). The body 4 narrows gradually in the middle part from the size of the plane cross sections in the upper and lower parts. In this middle part, the plane cross section comprises those arc portions with a curvature radius of R1 and those arc portions with a curvature radius of R2, which is relatively large and close to a flat line FIG. 3(*b*)). The whole periphery of the plane cross section has no hollowed portion. The bottle 1 also is a product of a synthetic resin (See FIG. 3(*d*)).

The bottle 1 of this embodiment has an out-of-round shape in its plane cross section over the entire height of the body 4. The Rs value indicating the out-of-roundness ranges from 1.06 for the middle part to 1.09 for the upper and lower parts.

Shrink film 9 is wrapped around the body, ranging from the middle height of the shoulder 3 to the upper portion of the bottom 5. Both the upper and lower ends of the film are located on the inclined plane so that there would be no vertical slippage of the film. As shown in FIGS. 3, the plane cross section of the body has no hollowed portion around the periphery, and thus the shrink film 9 is wrapped around the body tightly with no substantial gap between the body wall and the film.

In a test, the bottle 1 of this embodiment was wrapped in the shrink film 9, and was filled with 350 ml of water at 20° C. to give a head space of 17 ml. The bottle was put in a freezer at the upright position and was left to freeze at a temperature of −20° C. No shrink film 9 was torn up, and the wrinkles were quite limited.

The body of the frozen bottle 1 showed a flat portion that had been swelled entirely. In the middle part, the plane cross section came close to the shape of a perfect circle that has the same circumferential length as the periphery of the body before deformation, as shown by a chain double-dashed line in FIG. 4.

Following are approximate calculations of volume increase, etc., required to design the plane cross section of the body 4 of the bottle 1 in this embodiment.

(1) Calculation of the volume increment:

$$350\ \text{ml} \times 0.09 = 31.5\ \text{ml}$$

(2) Calculation of head space usable to absorb the increase in volume:

The head space at 20° C. is 17 ml. If an allowable pressure increase inside the head space, as caused by the freeze-derived volume increase in the contents, is set at a maximum of 196.1 KPa (2 kgf/cm$^2$), which is 3 times as much as atmospheric pressure, then the volume utilizable for absorbing the freeze-derived volume increase amounts to 11.3 ml, based on the Boyle-Charles' law.

(3) Calculation of the volume required to absorb within the body 4:

From (1) and (2):

$$31.5 - 11.3 = 20.2\ \text{ml}$$

(4) Calculation of Rs value:

In this embodiment, the volume set for absorption accounts for about 80% (293.6 ml) of the bottle volume (inner capacity) of 367 ml. The required average Rs value is calculated as follows:

$$(293.6 + 20.2)/393.6 = 1.07$$

The above-described approximate calculations are a mere example, which is required to design the plane cross section of the body 4 of the bottle 1. The volume necessary to be absorbed by the deformed body 4 is a part of the freeze-derived volume increase, and this volume is known from the capacity of the bottle 1, the allowable head space volume, and the filling temperature. The Rs value can be used as a guide to determine the plane cross-sectional shape of an out-of-round circle and the height of the body in which the out-of-round shape is retained, while taking outer appearance into consideration.

Figure 5:
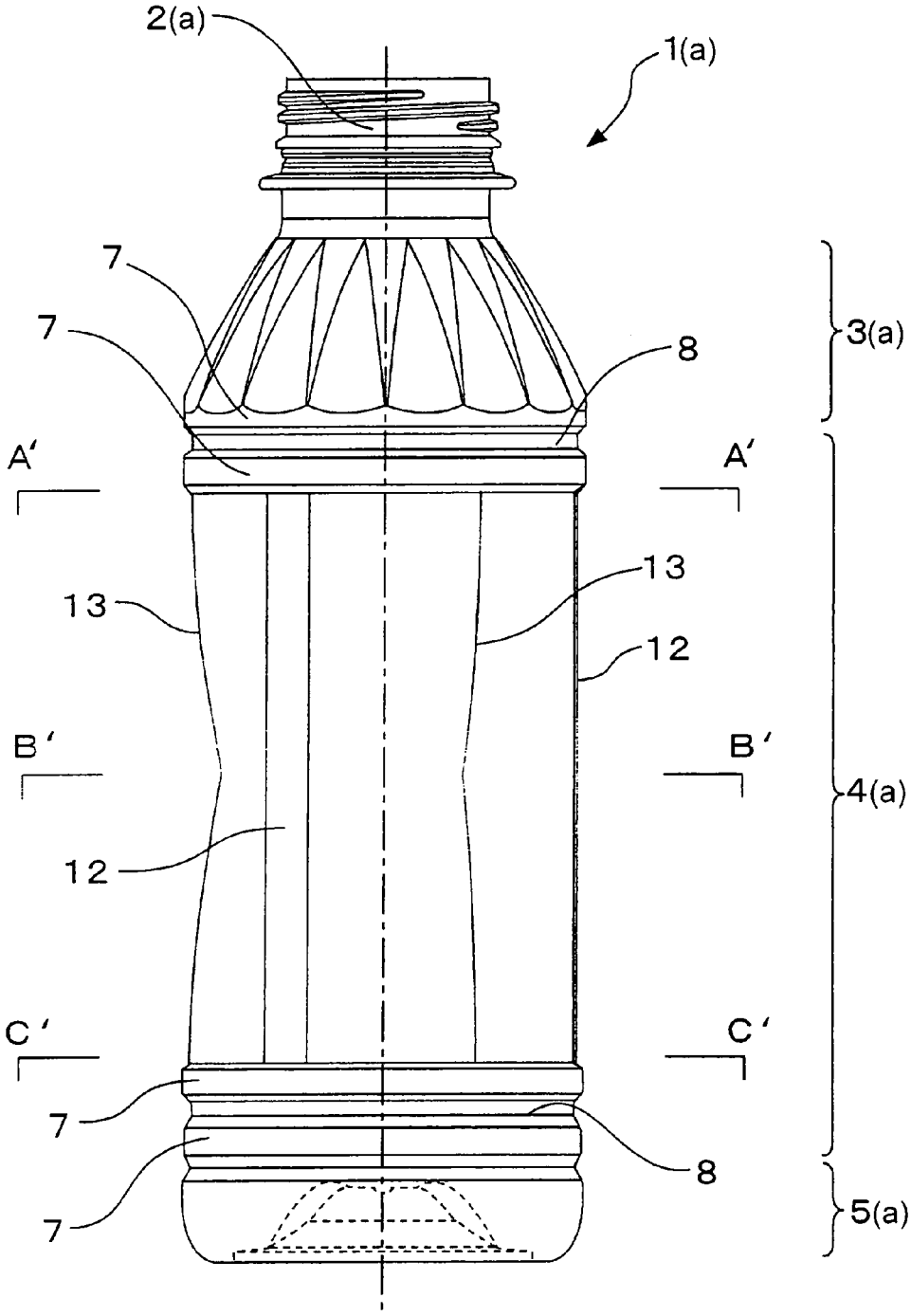
FIG. 5 is a front elevational view of the bottle in the second embodiment of this invention.
Figure 6:
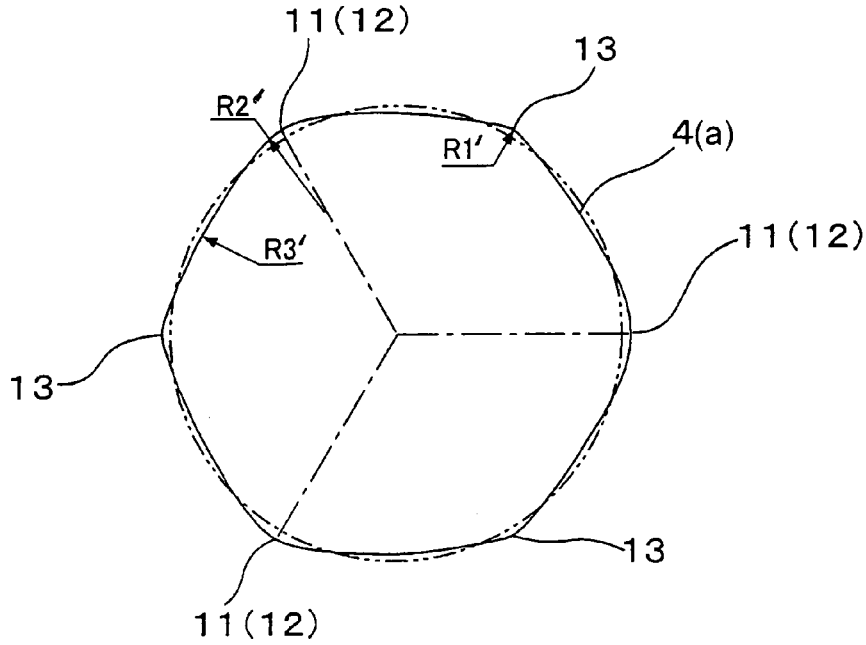
FIG. 6 show the bottle of FIG. 5, in which (a) is a cross-sectional plan view taken from lines A-A and C-C in FIG. 5; and (b) is a cross-sectional plan view taken from line B-B.
Figure 6:
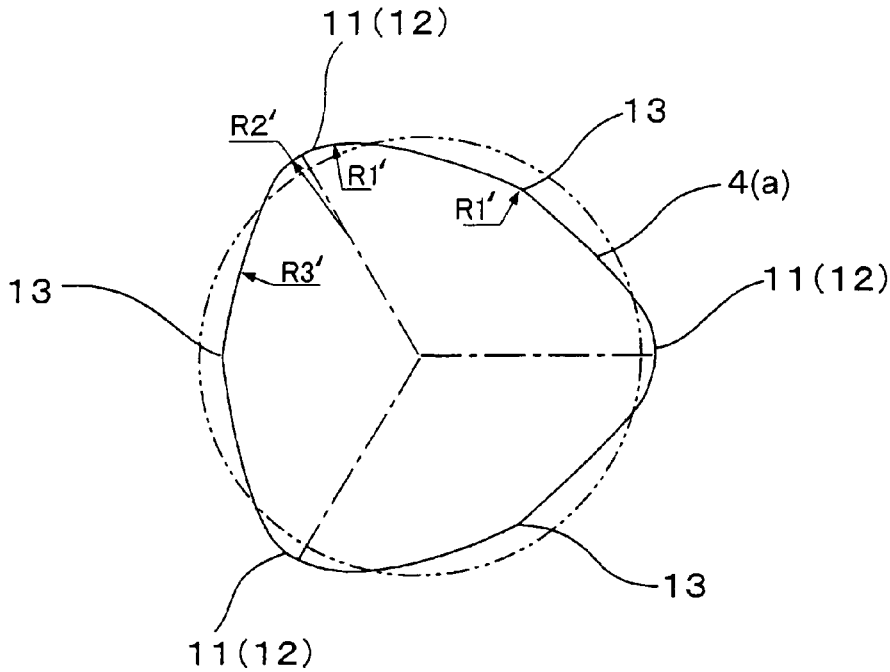

FIGS. 5 and 6 show the synthetic resin bottle in the second embodiment of this invention, which is a biaxially drawn, blow-molded PET bottle with a capacity of 500 ml. The bottle 1(*a*) comprises the neck 2(*a*), the shoulder 3(*a*), the body 4(*a*), and the bottom 5 (*a*). On the whole, the body 4(*a*) has a cylindrical shape, with its hexagonal plane cross section being almost an isotropic shape. The body 4(*a*) narrows gradually in the middle part from the size of the plane cross section in the upper and lower parts at those positions of alternate ridge line 13.

FIG. 6 shows the plane cross-sectional shapes of the bottle 1(*a*), in which FIG. 6(*a*) is a cross-sectional plan view of the body 4(*a*) in the upper and lower parts, taken from lines A'-A' and C'-C' in FIG. 5; and FIG. 6(*b*) is a cross-sectional plan view of the body 4(*a*) in the middle part, taken from line B'-B' in FIG. 5.

As obvious from FIG. 6(*a*), the body 4(*a*) in the upper and lower parts has a plane cross-sectional shape of a roughly regular hexagon. Each side is not straight but is in an arc, which curves outward, though close to a flat side, at a large curvature radius of R3'. Three crests 11 are formed at positions of an equal central angle, by selecting three apexes at alternate positions from among all the 6 apexes. These crests 11 have a rounded arc shape with a curvature radius of R2'. The remaining 3 apexes have an arc with a relatively small curvature radius of R1'. On the whole, the plane cross section of the body 4(*a*) has no hollowed portion or no reversible portion where the curvature radius is reversed from plus to minus, or vice versa.

FIG. 6(*b*) shows the plane cross-sectional shape of the body 4(*a*) in the middle part. The 3 apexes of the regular hexagon are used as the crests 11 and stay in positions in the upper and lower parts. On the other hand, the body 4(*a*) narrows in the middle part at those apexes other than the crests 11 (the positions shown by the ridge lines 13 in FIGS. 6) as these apexes are at positions nearer to the central axis.

From a detailed inspection of this plane cross-sectional shape, it is found that the abutting crests 11 are connected to one another by the arcs that curve outward and have the curvature radii of R1', R3', R2', R3', and R1', without forming any reversible portion. On the whole, the plane cross section of the body 4(*a*) has no hollowed or reversible portion. The plane cross-sectional shape is not flat but is tri-axially symmetrical and almost an isotropic shape in the circumferential direction.

The crests 11 stay in positions in the plane cross section of the body in the upper and lower parts. At other apexes, the ridge lines 13 move toward the center as the body narrows gradually in the middle part. Thus, the plane cross-sectional shape changes from the shape of FIG. 6(*a*) to the shape of FIG. 6(*b*).

As described above, the bottle 1(*a*) is formed by changing the plane cross section of the body 4(*a*). According to this design, upright pillars 12 are formed vertically by the crests 11 at 3 points of an equal central angle on the periphery of the plane cross section. Because of these pillars 12, the bottle 1(*a*) entirely retains the rigidity even if the body narrows in the middle part, as shown in FIG. 5.

Two each of the circumferential ribs 7 are disposed in the upper part and the lower part of the body, at positions near the border between the shoulder 3(*a*) and the upper part of the body 4(*a*) and between the bottom 5(*a*) and the lower part of the body 4(*a*), respectively. These ribs 7 can be used to define the upper and lower limits to the area where the body is deformed by the freeze.

The body 4(*a*) of the bottle 1(*a*) in this embodiment has the plane cross-sectional shape of an out-of-round circle at whatever level of the body height ranging from just beneath the circumferential rib 7 in the upper part to just on the circumferential rib 7 in the lower part of the body 4(*a*). The Rs value associated with the extent of out-of-roundness is in the range of 1.12 in the middle part (FIG. 6(*b*)) to 1.03 in the upper and lower parts. A regular hexagon has an Rs value of about 1.08. However, in this embodiment, the hexagon shows a small Rs value because each side of the regular hexagon is formed by an arc that curves outward, and because each apex is rounded. FIGS. 6(*a*) and 6(*b*) show a perfect circle drawn in a chain double-dashed line, with the perfect circle having the same circumferential length as each plane cross section of the body.

Shrink film is wrapped around the body over almost entire height of the body 4(*a*) by positioning the upper and lower ends of the film at grooves 8, which are formed between two circumferential ribs 7 respectively in the upper and lower parts of the body 4(*a*). The shrink film is tightly wrapped around the bottle with no substantial gap between the bottle and the film.

In a test, the bottle 1(*a*) of this second embodiment was wrapped in the shrink film 9(*a*) (not shown), and was filled with 500 ml of water at 20° C., leaving a head space of 17 ml. The bottle was put in the freezer at a standing position and was left to freeze at a temperature of −20° C. No shrink film 9(*a*) was torn up, and the wrinkles were quite limited.

Concerning the deformation of the bottle in the middle part, FIG. 6(*b*) shows the shape close to a perfect circle drawn in the chain double-dotted line. From an appearance point of view, there was no conspicuous deformation of the body 4(*a*) in the upper and lower parts because deformation is kept under control in the areas near the circumferential ribs 7 where the plane cross-sectional shape has an Rs value as small as 1.03.

Thus, the bottle deforms under the freezing condition mainly in the middle part of the body where the bottle gradually narrows. Nevertheless, the bottle retains its isotropic shape without collapsing the tri-axial symmetry because of the action and effect of the three pillars 12, and could be maintained under the freezing condition without giving large damage to outer appearance. Furthermore, there is no deformation of the bottom 5(*a*) because of the action and effect of the circumferential ribs in the lower part of the body. Even under the freezing condition, the bottle maintains stably its upright standing position, and thus is effective in the storage and/or transportation of multiple bottles neatly packed in rows.

Figure 7:
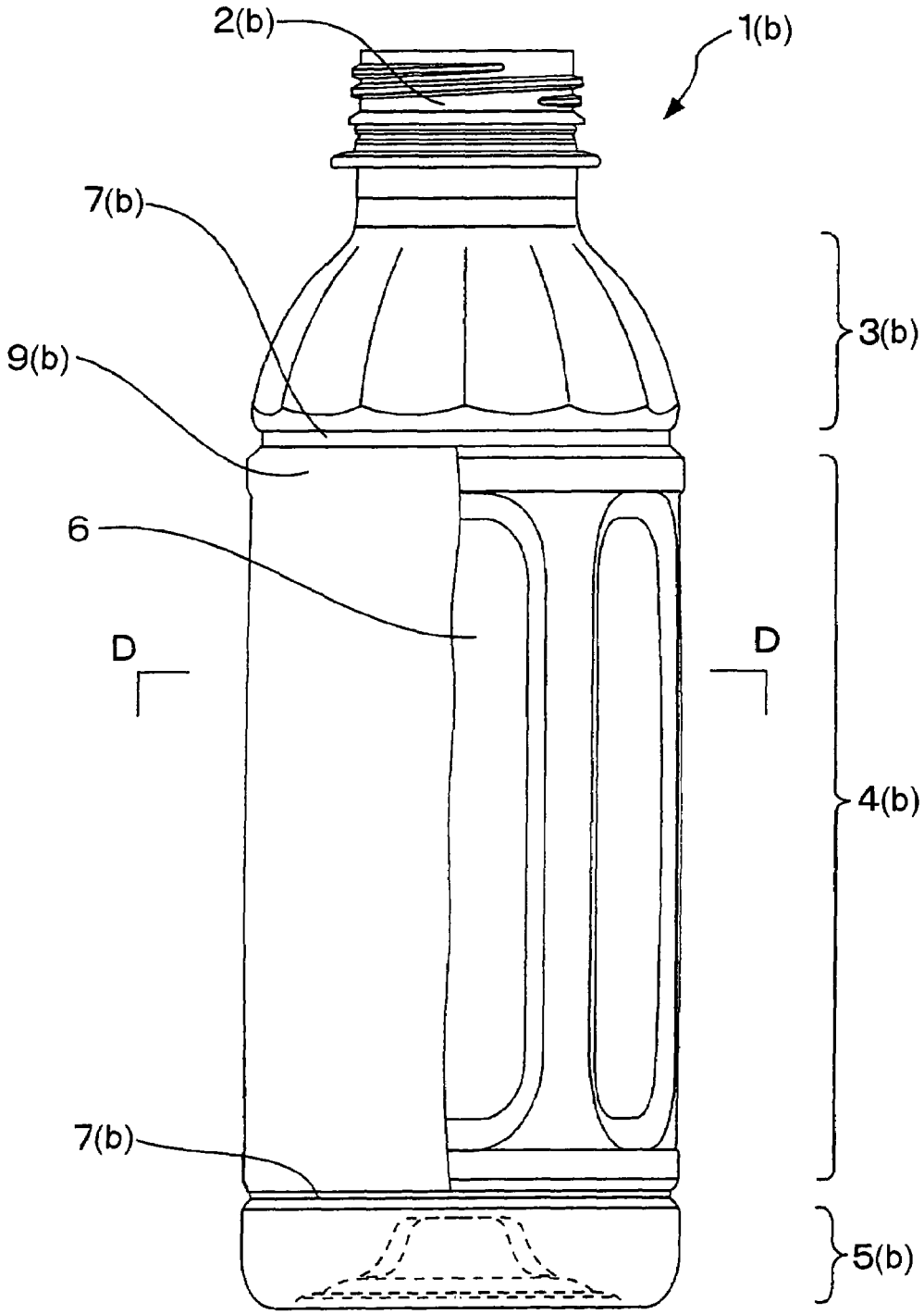
Fig.7 PRIOR ART
FIG. 7 is a front elevational view of a bottle in a comparative example.
Figure 8:
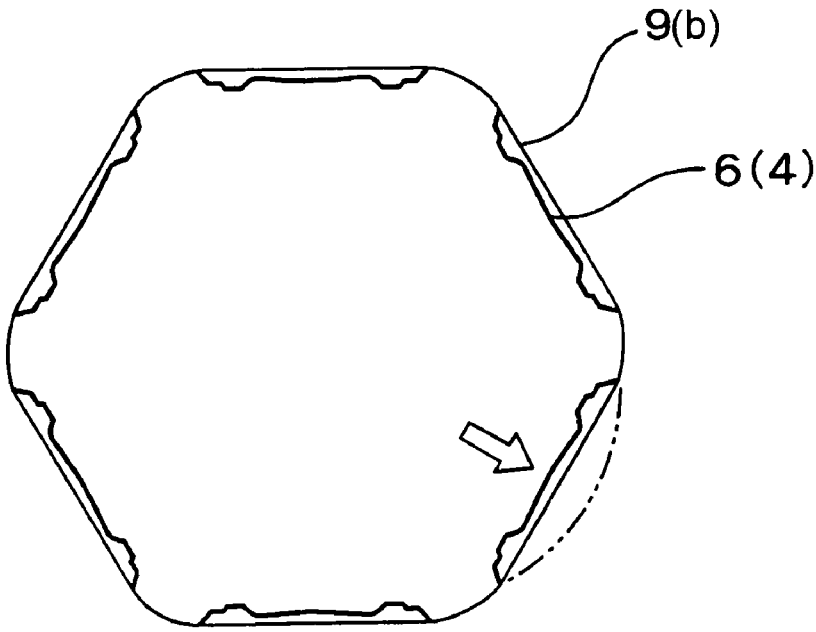
Fig.8 PRIOR ART
FIG. 8 is a cross-sectional plan view taken from line D-D in FIG. 7.

FIGS. 7 and 8 show a conventional example of a round bottle 1(*b*), which has been biaxially drawn, blow-molded into a PET bottle with a capacity of 500 ml. Vacuum panels 6 are disposed at 6 axisymmetnical points over the approximately entire height of the body 4(*b*) by caving in the body wall. The upper and lower ends of the shrink film are set at the positions of circumferential 7(*b*) in the upper and lower parts of the body 4(*b*) so that there would be no vertical slippage of the film.

As can be seen in the plane cross section of FIG. 8, there are gaps between the outer surface of the body 4(*b*) and the shrink film 9(*b*) in the portions where vacuum panels 6 are disposed.

The bottle of this comparative example was tested in the same way as with the bottle of this invention, by filling the bottle with water at 20° C. and leaving a head space of 17 ml. The bottle was put in a freezer at a standing position and was left to freeze at a temperature of −20° C. In this test, the hollowed vacuum panels 6 were swelled outward in the arrowed direction (See FIG. 8 for the arrow and the chain double-dotted line). The shrink film 9(*b*) was torn up because of the expansion.

The operation of this invention is not limited to the above-described embodiments, but is also accomplished commonly. The volume necessary for the deformed body 4(*b*) to absorb is a portion of the freeze-derived volume increase, and is known from the capacity of the bottle 1(*b*), the allowable head space volume, and the filling temperature. The Rs value can be used as a guide to determine a suitable plane cross-sectional shape in the middle part of the body 4(*b*), while taking outer appearance into consideration.

If a product is used by filling the synthetic resin bottle of this invention with contents that have water as a main component and by freezing the contents, the bottle deforms into a swelled shape due to the freeze of the contents. It is necessary for such a product to be designed so that the bottle would not be broken, while giving consideration also to the merchantability, such as the outer appearance, of the product. If the bottle is used by melting the frozen contents partially, there is a problem in that when the bottle is opened, the swelled bottle returns to its original shape, and the contents burst out. Therefore, in order for this problem to be eliminated, the product design requires full assumption on how the bottle is utilized.

The product design standards obtained by the inventors are as follows:

When the bottle was designed, these standards are such that the conditions shown by the Formula (1) and (2) are satisfied by the volume relationships concerning product specifications and mode of utilization, including bottle shape, type of the contents, and the filling amount:

$$C_{OF} > \alpha(v_{sf}/v_{sl})V_l + (1-\alpha)V_l \quad (1)$$

$$\Delta C_{cr} > (v_{sf}/v_{sl})V_l - C_{OF} + \beta V_h \quad (2)$$

where $C_{OF}$ is the fill capacity of the bottle at a given standard temperature $T_r$; $\Delta C_{cr}$ is the limit capacity increment previously set for a critically swelled condition; $V_l$ is the volume of the contents with which the bottle is filled at a given standard temperature $T_r$; $V_h$ is the volume of head space inside the bottle at a given standard temperature $T_r$; $V_{sf}$ and $v_{sl}$ are the specific volume of the contents at a given standard temperature $T_r$ and under the completely freezing condition, respectively; $\alpha$ is the weight ratio (in the range of 1 to 0) of the frozen portion; and $\beta$ is a constant in the range of 1 to 0. In Formula (2), $V_h = C_{OF} - V_l$ Formula (1) shows the design conditions under which to avoid the problem in that, at the moment the bottle is uncapped, the deformed bottle returns to its original shape, thus causing the contents to burst out. The term $\alpha(v_{sf}/v_{sl})V_l$ in the right-hand side is the volume of a frozen portion of the contents; $(1-\alpha)V_l$ is the volume of a liquid portion of the contents; and thus the sum of both terms is the total volume of the contents in the partially frozen state, where an $\alpha$ of 1 corresponds to a completely frozen state. At that time, the contents has the volume of $(v_{sf}/v_{sl})V_l$.

The given standard temperature Tr for evaluating $V_l$, $V_h$, and $v_{sl}$ is not limited in particular. A temperature of about 20° C. is favorable for evaluation. Incidentally, the specific capacity $v_{sl}$ of water at 20° C. is 1.00 $cm^3/g$, and the specific capacity $v_{sf}$ of ice at 0° C. is 1.09 $cm^3/g$. The ratio of both specific capacities, $v_{sf}/v_{sl}$, is 1.09.

Formula (1) assumes a mode of use in which the bottle is opened under the conditions that the contents have melted partially from complete ice to a predetermined level of a value. If the bottle were opened under such an assumption, there would be no burst-out or spillover of melted contents. This can be done under the conditions of Formula (1), by fixing the type of contents (which determines both of $v_{sf}$ and $v_{sl}$), the volume $V_l$ with which the bottle is filled, and the suitable mode of use, so that $C_{OF}$, the fill capacity of the bottle at a given standard temperature $T_r$, can satisfy the conditions of Formula (1) that give the predetermined level of $\alpha$ value. This $C_{OF}$ corresponds to the total capacity of the bottle including the neck portion, and can be obtained by filling the bottle with the contents to an overflow state at a given standard temperature $T_r$.

Formula (2) is used to set the conditions associated with the bottle deformation into the swelled shape, which is caused by the increase in the volume of contents at the time of complete freeze. The volume on the right-hand side of Formula (2) corresponds to a volume that would come out of the neck when the contents are frozen completely under the uncapped condition. The bottle would expand under the capped condition to an extent corresponding to the volume that comes out of the neck.

Products were obtained by filling the bottle with a fruit juice drink, tea, etc., at a high temperature of about 90° C. for sterilization. The bottles were capped and sealed. At room temperature, the bottle deforms due to depressurization and a resultant decrease in the volume of the contents, and the liquid level rose. As described for the first embodiment, the freeze-derived increase in the volume of the contents compresses the head space air inside the capped bottle. If the pressure rises greatly, the cap seal is damaged.

For this reason, all the head space volume, $V_h$, cannot be utilized to absorb the freeze-derived volume increment. $\beta$ is a constant in the range of 0 to 1 and shows the proportion occupying in the head space volume $V_h$, which cannot be utilized to absorb the freeze-derived volume increment. The higher the seal strength, the more air in the head space can be compressed. $\beta$ can be a value close to 0 at a high seal strength.

In the meantime, the limit capacity increment, $\Delta C_{cr}$, is a measure to be determined by what extent the bottle is allowed to deform into a swelled shape, from the points of view of outer appearance, standing property, storage, and transporting capacity, etc. $\Delta C_{cr}$ is determined in light of the purpose of use, and in the cases of use where the deformation into the swelled shape, or even the distorted deformation, has no problem, $\Delta C_{cr}$ can be calculated from the fill of the contents at the time of burst-out, while taking safety coefficient into consideration. If it is desired to give the user a good impression or a secure feeling, then the limit capacity increment, $\Delta C_{cr}$, can be determined to the extent to which there is no remarkably distorted deformation.

Thus, in the products to be used by freezing the contents, Formulas (1) and (2) set the guidelines for the product design associated with the product specifications including bottle shape and with the mode of use. Products are designed in such a way that the levels of such terms as $v_{sf}$, $v_{sl}$, $V_l$, $V_h$, $\beta$, $\alpha$, $C_{OF}$, and $\Delta C_{cr}$ satisfy the conditions of Formula (1) and (2). Thereby, the bottle products can be stored and used safely for the applications in which the bottles are used by freezing the contents.

More specifically, products can be designed in various ways. For example, if the first matters to be fixed include the shape of the bottle to be used, and the mode of uses, such as what extent the contents should be frozen to, then the filling volume V, and the head space volume $V_h$ can be adjusted correspondingly. On the other hand, if only the mode of uses is fixed at first, then the bottle shape and the ratio of the filling volume $V_l$ and the head space volume $V_h$ can be adjusted correspondingly.

The $\Delta C_{cr}$ for the bottle in the above-described embodiment can be raised within a limit that never gives damage to outer appearance. If an even higher level of $\Delta C_{cr}$ is required, the bottle can be designed by using the above-described Rs value as the guide to select an appropriate bottle shape, and by utilizing a regular quadrangle (having an Rs value of 1.27) as the plane cross section of the body.

Figure 9:
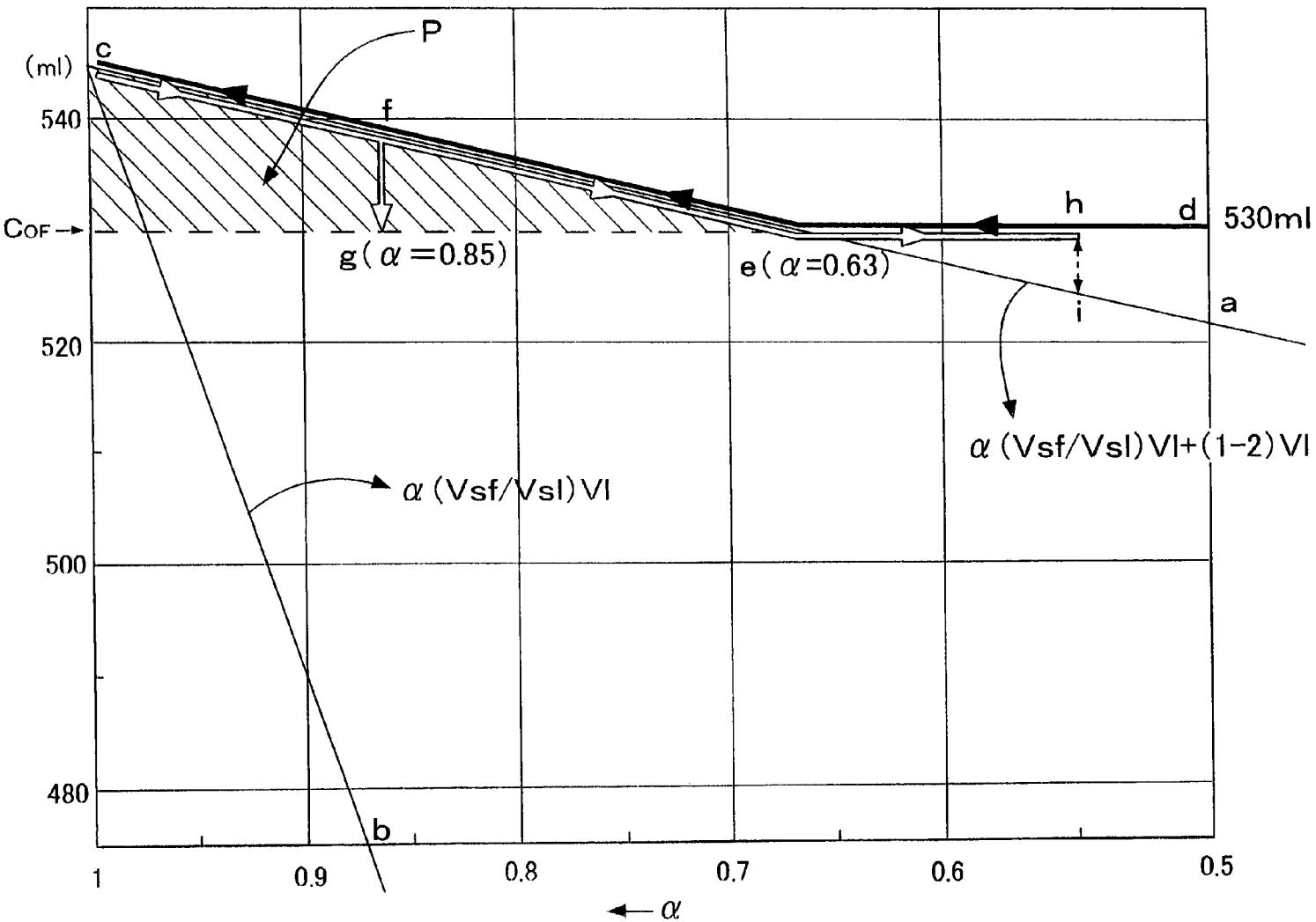
FIG. 9 is an explanatory diagram showing graphically the changes in the volume of contents and the capacity of the bottle observed in the freezing and unfreezing processes.

FIG. 9 is an explanatory graph obtained by calculating the volume of the right-hand side of Formula (1) while changing the weight ratio a of the frozen portion in a capped and sealed bottle having a fill volume $V_1$ of 500 ml. The horizontal axis indicates $\alpha$; and longitudinal axis, the volume, in ml, of the contents. The c-a line shows the entire volume of the contents $(\alpha(v_{sf}/v_{sl})V_1+(1-\alpha)V_1)$. The c-b line shows the volume of the frozen portion $(\alpha(v_{sf}/v_{sl})V_l)$. The d-e-c line shows the change in the capacity of the bottle during the freezing process in the case where the bottle has a fill capacity, $C_{OF}$, of 530 ml.

In the range of d-e, there is no deformation into the swelled shape. At Point (e) ($\alpha$=0.63), the contents L reach a volume of 530 ml. When the freezing process further goes on, the bottle deformation into the swelled shape proceeds along the line e-c and reaches the completely frozen state at Pont (c). Along with this process, the plane cross section of the body changes from an out-of-round circle to a perfect circle (See FIG. 4). Nevertheless, there is a case where the contents do not freeze completely. The hatched area P in FIG. 9 shows an area where the bottle deforms into the swelled shape.

The line c-f-g shows an example of sale of a completely frozen liquid product, or its mode of use. As shown in the line c-f, a case is assumed in which the completely frozen contents are allowed to melt only in a small amount and are served as a drink. If the bottle is opened at Point (f) ($\alpha$=0.85), the bottle returns from the swelled state to the original shape. Depending on the frozen state, the bottle capacity decreases along the line f-g in an extreme case, and the contents are in the danger of bursting out or spilling over in the amount corresponding to the height of f-g.

On the other hand, the line c-e-h shows another example of sale or mode of use of a completely frozen liquid product. In this example, the bottle is opened after nearly a half ($\alpha$=0.55) of the contents has melted, and the bottle is in no danger of bursting out or spilling over. This is because when the bottle is opened, the volume of the contents (the level at Point (i)) is already lower than 530 ml, which is the fill capacity or $C_{OF}$ of the bottle.

Thus, the contents can be prevented from bursting out or spilling over by setting the fill capacity, $C_{OF}$, of the bottle and conducting the shape design of the bottle, so as to satisfy the conditions of Formula (1), while making reference to the graph of FIG. 9 and giving consideration to the extent to which the contents are allowed to melt before the products are sold or used. If a mode of use, such as the above-described line c-f-g is expected, the bottle is required to have a fill capacity, $C_{OF}$, of 540 ml or more. In addition, if the mode of use is not specified between the completely frozen state and the considerably melted state, the bottle must have 545 ml or more of the completely frozen volume at Point (c).

INDUSTRIAL APPLICABILITY

As described above, the bottle of this invention has been developed enough to absorb the increased volume under the freezing condition. Even if shrink film is wrapped around the body of the bottle, the film is not torn up, and the bottle can be utilized safely, giving no large damage to the outer appearance. The bottles neatly packed in rows can be effectively stored and transported. Therefore, the bottle of this invention is expected to find wide uses in the field where bottles are used by freezing them.

The invention claimed is:

1. A synthetic resin bottle comprising:

a body that has an out-of-round circular shape in any cross-sectional plan view taken over a certain height of the body, wherein:

the out-of-round circular shape has no hollowed portion that is caved inward;

the synthetic resin bottle has a cylindrical body, with the plane cross section shape being almost an- isotropic shape;

the body gradually narrows in the middle part except for portions consisting of crests which are disposed at 3 or more points of almost an equal central angle on the periphery of the plane cross section;

the plane cross section of the body in the middle part is in a shape obtained by connecting the crests to one another with 3 or more arcs that curve outward; and pillars are formed vertically on the body by the crests.

2. The synthetic resin bottle according to claim 1, wherein the plane cross section of the body in both the upper and lower parts has the shape of an n-th polygon where n is a natural number of 6 or more; and wherein at least 3 apexes located at almost an equal central angle are selected from among those apexes of the n-th polygon and are designated as the crests.

3. The synthetic resin bottle according to claim 2, wherein the crests have a rounded shape in the plane cross section of the body.

4. The synthetic resin bottle according to claim 2, wherein circumferential ribs are formed in the upper and lower parts of the body.

5. The synthetic resin bottle according to claim 2, wherein the body is wrapped in shrink film.

6. The synthetic resin bottle according to claim 2, wherein the bottle is a biaxially drawn and blow-molded product made of a polyethylene terephthalate-series resin.

7. The synthetic resin bottle according to claim 1 wherein the plane cross section of the body in the upper and lower parts is in the shape of a regular hexagon, with alternately located apexes being designated as the crests; and wherein the plane cross section in the middle part of the body is in a tri-axially symmetrical shape.

8. The synthetic resin bottle according to claim 7, wherein the crests have a rounded shape in the plane cross section of the body.

9. The synthetic resin bottle according to claim 7, wherein circumferential ribs are formed in the upper and lower parts of the body.

10. The synthetic resin bottle according to claim 7, wherein the body is wrapped in shrink film.

11. The synthetic resin bottle according to claim 7, wherein the bottle is a biaxially drawn and blow-molded product made of a polyethylene terephthalate-series resin.

12. The synthetic resin bottle according to claim 1, wherein the crests have a rounded shape in the plane cross section of the body.

13. The synthetic resin bottle according to claim 1, wherein circumferential ribs are formed in the upper and lower parts of the body.

14. The synthetic resin bottle according to claim 1, wherein the body is wrapped in shrink film.

15. The synthetic resin bottle according to claim 1, wherein the bottle is a biaxially drawn and blow-molded product made of a polyethylene terephthalate-series resin.

* * * * *

UNITED STATES PATENT AND TRADEMARK OFFICE

CERTIFICATE OF CORRECTION

PATENT NO. : 7,296,702 B2
APPLICATION NO. : 11/172941
DATED : November 20, 2007
INVENTOR(S) : Toshimasa Tanaka and Takao Iizura It is certified that error appears in the above-identified patent and that said Letters Patent is hereby corrected as shown below:

Column 1, line 15, after the word "shrink" the word --film-- should be added;

Column 1, line 57, "body wherein" should read --body, wherein--;

Column 3, line 9, between "of the" and "in a", --body-- should be added;

Column 5, line 27, "uniformly,-depending", should read --uniformly, depending--;

Column 9, line 21, "FIG. 3 show" should read --FIG. 3 shows--;

Column 9, line 31, "FIG. 6 show" should read --FIG. 6 shows--;

Column 9, line 55, "3(b)," should read --3(b))--;

Column 10, line 5, "line FIG. 3(b))." should read --line (See FIG. 3(b)).--;

Column 12, line 58, "circumferential 7(b)" should read --circumferential ribs 7(b)--;

Column 13, lines 36, 38, 42, 50, 54, 56, 60 and 61, "$V_l$" should read --$V_1$--;

Column 13, line 45, "$T_r$; $V_{sf}$" should read --$T_r$; $v_{sf}$--;

Column 13, line 61, "Tr" should read --$T_r$--;

Column 13, line 69, "level of a" should read --level of α--;

Column 14, line 65, "V," should read --$V_1$--;

Column 14, lines 5, 56, and 68; and "$V_l$" should read --$V_1$--;

Column 15, line 10, "ratio a" should read --ration α--;

Column 15, line 15, "$V_l$" should read --$V_1$--;

Column 15, line 24, "Pont (c)" should read --Point (c)--;

UNITED STATES PATENT AND TRADEMARK OFFICE

CERTIFICATE OF CORRECTION

PATENT NO. : 7,296,702 B2
APPLICATION NO. : 11/172941
DATED : November 20, 2007
INVENTOR(S) : Toshimasa Tanaka and Takao Iizura It is certified that error appears in the above-identified patent and that said Letters Patent is hereby corrected as shown below:

Column 16, line 10, “almost an-” should read --almost an--

Column 16, line 38, “claim 1” should read --claim 1,--; and

In the Abstract, line 4, “contents have” should read --contents that have--.

Signed and Sealed this

Sixth Day of May, 2008

JON W. DUDAS
*Director of the United States Patent and Trademark Office*